United States Patent [19]

Muchisky et al.

[11] 4,098,266

[45] Jul. 4, 1978

[54] MASSAGE APPARATUS

[75] Inventors: Thomas Peter Muchisky, 12153 Queen's Charter Ct., Creve Coeur, Mo. 63141; Russel A. Nemer, Creve Coeur, Mo.

[73] Assignee: Thomas P. Muchisky, Creve Coeur, Mo.

[21] Appl. No.: 754,503

[22] Filed: Dec. 27, 1976

[51] Int. Cl.[2] ..... A61H 1/00

[52] U.S. Cl. ..... 128/36

[58] Field of Search ..... 128/34–36, 128/44–46, 54, 55

[56] References Cited

U.S. PATENT DOCUMENTS

| | | | |
|---|---|---|---|
| 750,735 | 1/1904 | Turck | 128/36 |
| 859,674 | 7/1907 | Lindstrom | 128/36 |
| 976,423 | 11/1910 | Ziegler | 128/51 |
| 1,234,700 | 7/1917 | McLain | 128/41 |
| 1,301,866 | 4/1919 | Moore | 128/35 |
| 1,723,268 | 8/1929 | Conill | 128/36 |
| 1,958,936 | 5/1934 | Bajette et al. | 128/35 |
| 2,174,452 | 9/1939 | Torrison | 128/36 |
| 2,347,554 | 4/1944 | Gothers | 128/36 |
| 2,422,639 | 6/1947 | Wenander | 259/1 |
| 2,489,582 | 11/1949 | McCready | 128/46 |
| 2,675,800 | 4/1954 | Voorhees et al. | 128/36 |
| 3,053,250 | 9/1962 | Stubbs | 128/41 |
| 3,314,418 | 4/1967 | Tiemes | 128/36 |
| 3,468,304 | 9/1969 | Teranishi | 128/36 |
| 3,504,665 | 4/1970 | Bakunin et al. | 128/36 |
| 3,779,238 | 12/1973 | Cutler | 128/36 |

*Primary Examiner*—Lawrence W. Trapp
*Attorney, Agent, or Firm*—Rogers, Eilers & Howell

[57] ABSTRACT

A massage unit designed to produce percussive directional stroking for medical purposes such as: to loosen and to mobilize, in a selected direction, bronchial secretions or other congestive material in humans or animals; to improve blood circulation, and; to relax muscles, has a portable housing that houses a motor which transmits rotary power through a swivel coupling assembly attached to the housing through a drive cable to an eccentric weight housed within a palm-sized applicator head having a resilient applicator pad to be applied to the chest, back, arms, legs or other parts of a patient's body. The eccentric weight rotates freely within the head to cause the applicator pad to transmit a percussive directional stroking force to the body. The resultant force transmitted to the body has two components: one perpendicular to the body to loosen congestive material, and one force component parallel to the body to mobilize loosened congestive material in a selected direction. The applicator head is compact and shaped to be easily held with one hand and to allow the patient to lie on it for therapy with minimal discomfort. An arrow on the applicator head indicates the direction of the impulse transmitted to the patient by the eccentric weight, and a belt unit is supplied to support and hold the applicator head firmly against the body to allow an individual patient to self-administer treatments in difficult-to-reach locations on his own body, such as his back or sides. Foam pads which encase the applicator head are also supplied to minimize the transmission of vibration to the user's hand or therapist's hand, and to permit the patient to lie more comfortably on the applicator head during therapy.

20 Claims, 11 Drawing Figures

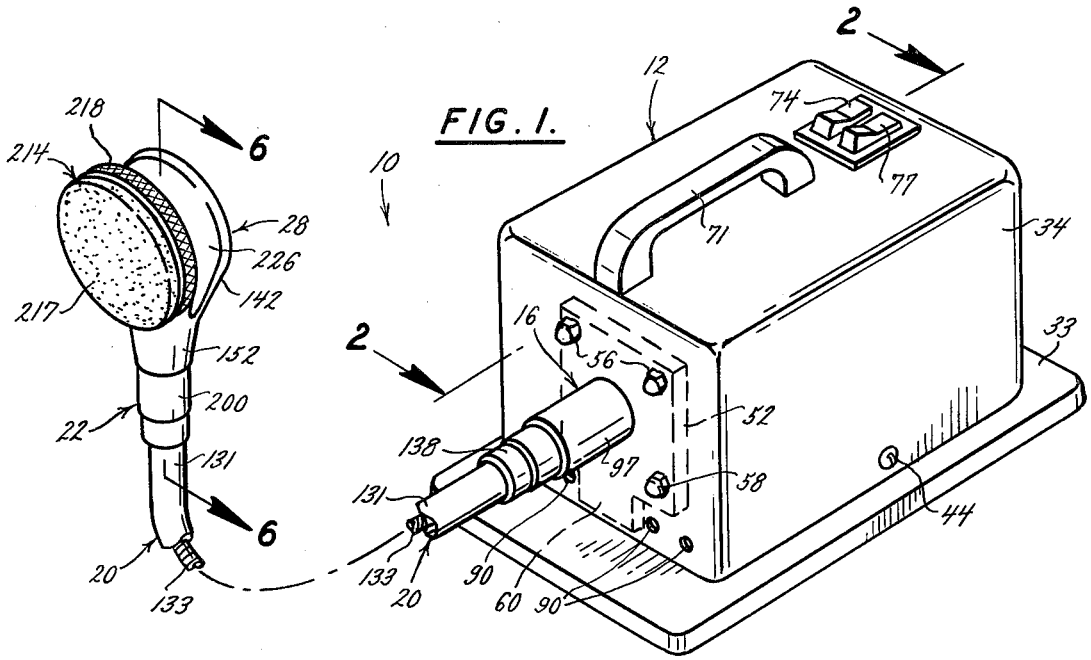
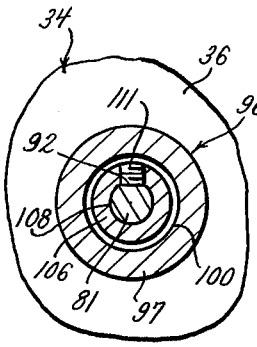
FIG. 5.
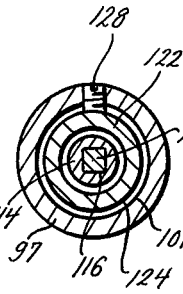
FIG. 4.
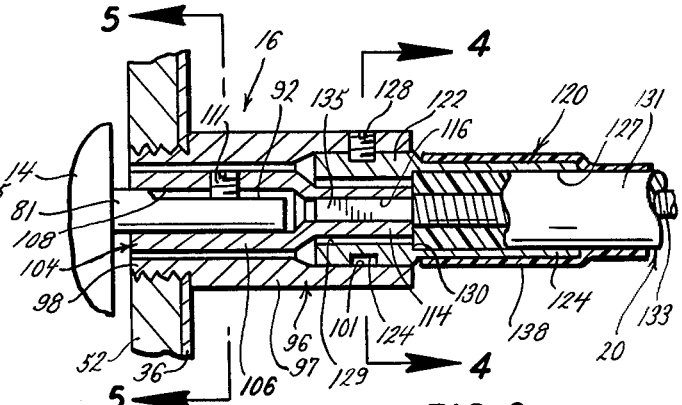
FIG. 3.
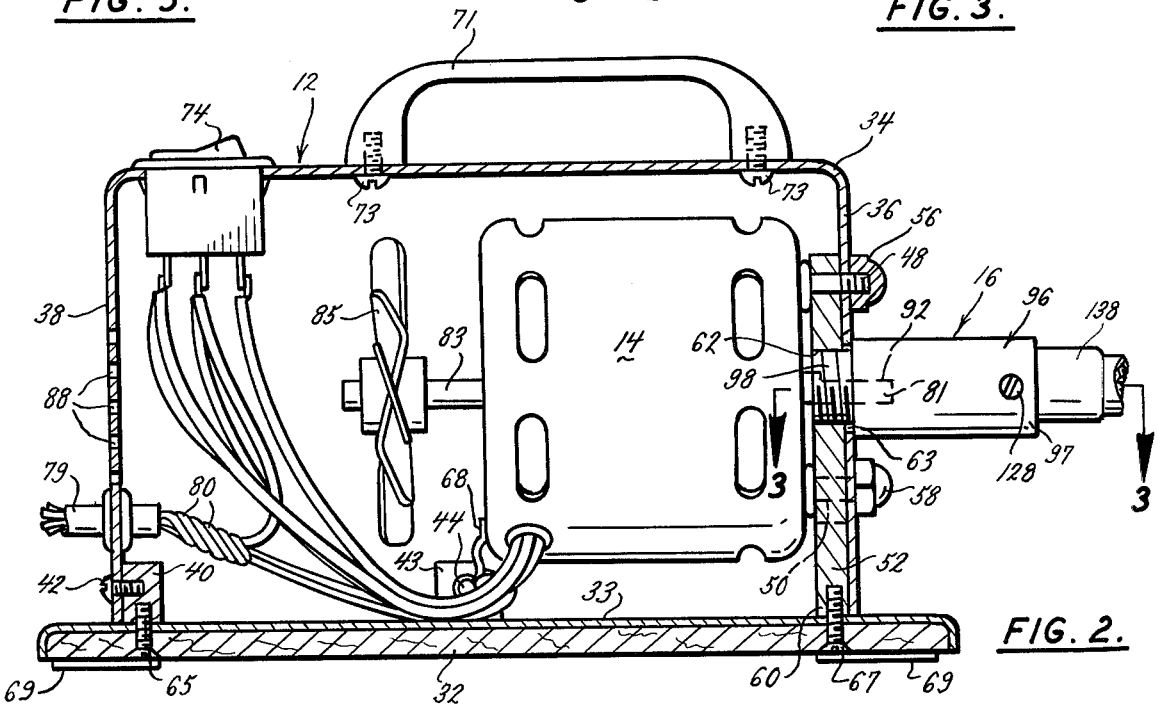
FIG. 2.

MASSAGE APPARATUS

FIELD OF THE INVENTION

This invention relates to medical devices in which medical benefits are achieved through application of vibratory or percussive forces to the body. The invention can be used to loosen and to mobilize, in a selected direction, bronchial secretions or other congestive material, in the lungs or other body parts of humans or animals and in this respect has relationship to devices or techniques which rely upon engagement of the chest or back of an individual to impart a force to the chest cavity to bring about the loosening of bronchial secretions in the lungs. Providing such loosening and movement of bronchial secretions or other congestive matter is beneficial to patients suffering from such respiratory ailments as emphysema, asthma, cystic fibrosis, tuberculosis, post-operative congestion problems, and other congestive respiratory or congestive circulatory problems.

The invention is also related to improvements in devices used to apply force to parts of the body, such as the legs, to improve the circulation of blood or to mobilize edema fluids in the body parts. The invention is further related to devices used to relax the muscles of the body through vibratory massage.

In the prior art one method used to loosen bronchial secretions has been by hand massage and hand percussion. In this technique a nurse, therapist or other technician uses their hands to strike the back or chest of the patient to cause a loosening of the secretions. This can be painful to the patient and has even resulted in broken ribs or severe bruises, especially in infants and in older patients. Sometimes the hand of the nurse, therapist or technician is cupped to strike the back or chest of the patient to provide a suction effect as a result of the cupping so that this suction will have some impact upon loosening the secretions. However such cupping also can result in bruises and broken bones and is considered by many to be ineffectual. In all manual methods, however, the percussive forces are applied perpendicular to the body, and as such, are effective in loosening, but not in mobilizing congestive materials.

Percussion-type vibrators have also been used to loosen bronchial secretions. In their use, a nurse, therapist or technician holds the vibrator on the back or chest of the patient and the vibration unit is operated so that a vibrating member is forced in towards the patient, perpendicularly to his body, then out away from him repetitiously. This percussion-type, straight-in, straight-out movement loosens bronchial secretions but does not mobilize the secretions to move them out of the congested area.

Another type of vibration unit that is used is the oscillation type, in which the vibrating member oscillates about an axis perpendicular to the chest or back of the patient when it is applied. This type of unit provides a massaging circular oscillation force parallel with the surface of the patient's body but does not provide percussion to loosen the secretions so that they can be mobilized. And the parallel force is in a circular pattern, rather than uni-directional.

In all known prior art mechanical vibrators or percussion devices, patients are unable to lie on the vibration unit for self-therapy, nor are they able to apply the vibration unit to their own backs for self-therapy. Also, with the known prior art devices, the size and weight of the vibrating unit is too great to permit ease of self-therapy by children or elderly patients, and the straight-in, straight-out stroke of percussion-type devices presents dangers of injry if used for self-therapy by children or older patients.

SUMMARY OF THE INVENTION

The present device improves over the prior art. A motor unit contained in a portable housing has a shaft which is drivingly connected through a swivel coupling to one end of a cable and a sheath with the other end of the cable and sheath being attached to a coupling assembly in a vibration applicator head. The applicator head coupling is such that the rotation of the cable drives a connecting link rod engaged to a weighted eccentric member housed within a sealed cavity within the applicator head so that the eccentric member rotates within the head cavity about an axis that is generally parallel to the plane of a rubber applicator pad which is detachable connected to the applicator head. The applicator pad is applied to the patient's body such that the axis of rotation of the eccentric member within the cavity of the applicator head is also generally parallel to the patient's body at the place where the applicator is applied. The pad surface can be flat, concave, convex or of other shapes, and may be made of varying degrees of resilient materials.

The applicator head is so shaped that it can be easily held in the palm of one hand or can be attached to a belt or inserted in a cushioning sleeve or pad so that the applicator pad can be self-applied by a patient on that portion of his own body which requires treatment. The shape of the applicator head is generally that of a flat disc with the flexible drive cable connected at the peripheral edge of the disc so that the patient can lie on the applicator head for therapy without undue discomfort.

An arrow is located on the back of the applicator head and points in the direction of movement of the larger portion of the weighted eccentric member during the period when it is closest to the applicator pad. Observing the arrow, the applicator pad can be properly positioned against the body to mobilize congestive material in the direction desired. The rotary force of the eccentric is directed inward and outward relative to the patient as well as across that portion of the patient to which the pad is applied, in the direction of the arrow, said movement imparting an angular force to the patient's body, said force produced by both perpendicular and parallel components with respect to said portion of the individual. Thus the force components applied by the pad by virtue of the eccentric rotation are both of a percussion and a stroking nature which, in the case of bronchial secretions, causes such secretions to be loosened by the percussion effect and mobilized within the chest cavity by the stroking action, in the direction of the arrow.

When the applicator pad is applied to the body to improve circulation, such as to the legs, the rotation of the eccentric member causes a repeated uni-directional stroking to be given to blood vessels so that blood can be pushed in a preselected direction through the vessel. The deep stroking effect provided by the eccentric creates this stroking action not only in blood vessels near the surface of the skin but in deeper vessels as well. Thus blood in the legs can be directionally mobilized towards the heart or towards another selected area.

In the case of use for muscle relaxation, the applicator pad, when applied to the body, imparts a percussive and stroking force to the muscles to loosen congestive material within the circulatory and lymphatic systems of the muscles, and to force these waste materials in the direction of the stroking action and out of the body of the muscle. Therefore the waste products which are produced within the muscle by muscular exertion are loosened and mobilized out of the muscle to provide muscle relaxation.

In the preferred embodiment, the weighted eccentric member rotates freely within the housing without eccentrically engaging any component of the applicator head. The weighted eccentric allows for compactness and a generally flat, disc shape design so that the applicator pad can be easily held in contact with the body by a single hand of the patient, or by a self-attachable belt, or within a cushioned sleeve or pad, so that the patient can lie on the head with minimal discomfort. The head has a cover plate which permanently seals the head cavity so that the applicator pad can be safely detached and interchanged without over exposing the eccentric member.

The swivel coupling of the motor shaft to the transmission cable and sheath allows the applicator head to be turned to any position without torsional resistance of the cable cover sheath, and also allows the transmission sheath and cable to be disengaged from the motor and its housing. This allows ease of installation of the head to an applicator belt, or to a fitted cushioned sleeve and further provides compactness in packaging and shipping.

The portability, safety and capabilities for self-application permits the entire unit to be taken into the home of the patient for his use so that the patient does not have to travel to a medical center for treatment, nor is a second person required to provide treatment.

The present unit also has an applicator belt onto which the applicator head can be secured so that the belt can be strapped around the torso, legs, or other portions of the individual to hold the applicator in contact with such portion without the patient having to apply the applicator by hand. This permits individual use of the applicator at hard-to-reach locations on his body without the need of an attendant. The flat, disc shaped configuration of the head with the flexible drive cable attached at the periphery readily allows for the use of such belt attachment.

The present unit also has a resilient cushioned sleeve and a resilient cushioned pad into which the applicator head can be inserted, in order to minimize the transmission of vibration to the patient's hand, and/or in order to minimize the percussive directional stroking effect, should the patient find the effect too strong. The cushioned sleeve or the cushioned pad are particularly appropriate for use by children or older patients. Various shapes and sizes of sleeves and pads can be fitted over the applicator head. The cushioned sleeves and cushioned pads can also be combined with an applicator belt to provide for the self-administration of more gentle percussive directional stroking.

DESCRIPTION OF THE DRAWINGS

FIG. 1 is a perspective view of the vibration unit showing the transmission line connecting the head to the motor broken;

FIG. 2 is a side sectional view of the motor, motor housing, and the motor coupling assembly taken on the line 2—2 of FIG. 1;

FIG. 3 is a top section taken on the line 3—3 of FIG. 2 and showing the swivel motor coupling assembly;

FIG. 4 is a front section taken on the line 4—4 of FIG. 3 showing the swivel coupling assembly;

FIG. 5 is a front section taken on the line 5—5 of FIG. 3 showing the swivel coupling assembly;

DESCRIPTION OF THE PREFERRED EMBODIMENT

Figure 6:
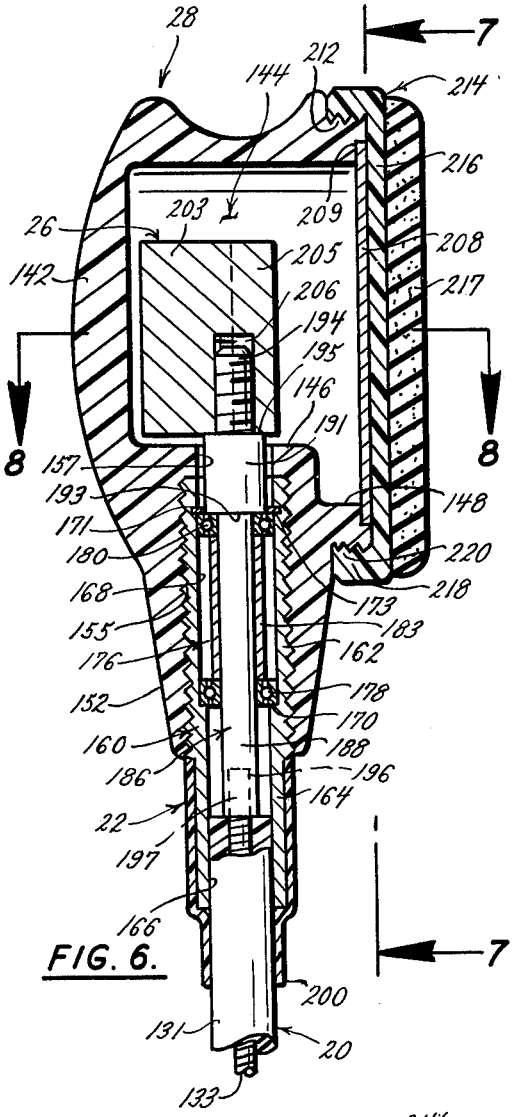
FIG. 6 is a side section of the applicator head taken on the line 6—6 of FIG. 1.

The vibration unit, generally depicted in the drawings as 10, has primary components which include a motor housing 12 that houses within it an AC motor 14 that transmits rotary power through a swivel coupling assembly 16 through a transmission line 20 and through a head coupling assembly 22 to rotate an eccentric weight 26 (FIGS. 6–8) which is housed within a vibration applicator head 28. The head 28 can be held against a patient's body by the hand or by a belt 30 (FIG. 9).

The motor housing 12 has a base 32, which can be of fiber board, covered by a metal sheet 33. A rectangular box cover 34, having a front wall 36 and a rear wall 38, is mounted above the base 32 and sheet 33. A fastening block 40 is secured to the interior of the lower end of wall 38 by a screw 42, while another fastening block 43 is secured to a side wall of box 34 by a screw 44 (FIG. 2).

The front end of motor 14 has secured to it upper bolts 48 and lower bolts 50 which extend first through bores in a spacer plate 52 and thence through bores in the front wall 36 of the box 34. Acorn nuts 56 and 58 are threaded on the ends of the upper bolts 48 and lower bolts 50 respectively to secure the motor firmly against the front wall 36.

Spacer plate 52, which can be of metal, has a reduced lower portion 60, as well as a threaded bore 62 which is concentric with a circular bore 63 in front wall 36. Both bores 62 and 63 are adapted to receive a sleeve yet to be described.

To secure base 32 and sheet 33 to box 34, a screw extends through the rear of base 32 and sheet 33 into block 40, and a screw 67 extends through the front of the base and sheet into the reduced portion 60 of spacer plate 52. A ground wire 68 is attached to the side screw 44 and extends therefrom to engage the casing of the motor 14. Foam support pads 69 are secured to the underside of the corners of base 32. The box 34 is thus held securely to the base 32 and sheet 33 to securely house the motor 14.

On the top side of box 34 a handle 71 is secured by screws 73 so that the housing 12 and motor 14 are portable. On the top rear of box 34 are located an on-off rocker switch 74 and a two-speed rocker switch 77. Both switches are conventional two-position switches. An electrical cord 79 extends through the box rear wall 38 and the wires 80 of the cord extend to the terminals of the switches 75 and 77, and also to the motor 14. The wires 80 are connected to the motor and to the switch terminals in the well-known manner so that the on-off switch 74 can be operated to energize the motor and rotate the shaft 81 extending from the front of the motor, and to rotate the rear motor shaft 83 and the fan 85 attached thereto. The two-speed switch 77 is wired so that the motor will rotate the shafts 81 and 83 at a slower speed when the switch 77 is in a first position and at a faster speed when the switch 77 is in a second position.

Ventilation holes 88 are located in the rear wall 38 of the box while ventilation holes 90 extend through the front wall 36. The fan 85 can thus act during motor operation to bring cooling air through the vent holes.

As seen more specifically in FIGS. 3–5, the front end of motor shaft 81 has a flat 92 which extends through the front bores 62 and 63. The shaft 81 is secured to the motor coupling assembly 16 in the following fashion. A fixed metal sleeve 96 has an enlarged portion 97 and a smaller threaded end 98 which extends through the front wall bore 63 and is screwed into the threaded bore 62 of spacer plate 52 so that the interior end of enlarged portion 97 of fixed sleeve 96 fits flush against the front wall 36. The fixed sleeve 96 has beginning at its threaded end a smaller cylindrical bore 100 which extends forwardly, tapering into a larger bore 101.

A shaft coupling 104 positioned within fixed sleeve 96 has an enlarged cylindrical segment 106 which has a bore 108 which receives the motor shaft 81 and its flat 92. A set screw 111 screws through the coupling segment 106 against the flat 92 so as to drivingly engage the coupling 104 to the shaft 81. The coupling 104 tapers outwardly as seen in FIG. 3 into a smaller cylinder segment 114 which has a square bore 116 adapted to receive a drive key to be described.

A swivel sleeve 120 has an enlarged cylindrical portion 122 having a circumferential groove 124. The enlarged swivel portion 122 is telescopically received in the outer bore 101 of fixed sleeve 96 and is held for swivel movement therein by a set screw 128 which screws through the fixed sleeve portion 97 into the groove 124. The enlarged portion 122 of swivel sleeve 120 tapers into a smaller cylindrical portion 124 which extends outside of fixed sleeve 96. The smaller portion 124 has a cylindrical bore 127 which extends inwardly into a smaller bore 129 within the enlarged swivel portion 122. A shoulder 131 is formed at the junction of these bores 127 and 129.

The transmission line 20 comprises a sheath 131, which can be of plastic fiber, that houses a cable 133, which can be of metal. The motor end of sheath 131 is held within the bore 127 of swivel sleeve 120 as by an adhesive so that the end of the sheath abuts the shoulder 131.

The cable 133 has secured to its end as by brazing a rectangular shaped metal key 135. The key 135 slidingly telescopes within the square bore 116 of coupling 106 so as to be drivingly engaged therein but to be removable therefrom by a pull of the hand when the set screw 128 is not engaged in groove 124 of swivel portion 122. A plastic cover sleeve 138 extends around the smaller portion 124 of swivel sleeve 120 and around a portion of sheath 131.

The engagement of motor shaft 81 with the coupling assembly 16 allows the rotation of the shaft 81 to drivingly rotate the cable 133. This rotation is transmitted through the cable to the eccentric member 26 within the head 28 by virtue of the head coupling assembly 22 which is engaged to head 28.

The head 28 (FIGS. 6–8) comprises a housing 142 which is in the shape of a generally flat disc which can be made of metal, plastic or ceramic material. The eccentric weight 26 is housed within a cavity 144 of housing 142. The cavity 144 has a rear chordal shaped (generally cylindrical with a flat bottom) portion 146 which extends into a larger cylindrical portion 148 at the open end of the cavity 144.

The head 28 has a lower handle portion 152 extending from the periphery of the disc shaped housing 142, and has a threaded bore 155 extending from its bottom upwardly into a smaller cylindrical bore 157 that extends into the cavity portion 146.

Bore 155 provides attachment means for the coupling assembly 22. This assembly includes a sleeve 160, which can be of metal, having an externally threaded upper end 162 which is screwed into bore 155. Sleeve 160 also has a smooth cylindrical outer end 164 which extends beneath the lower end of the handle 152.

The sleeve 160 has a lower cylindrical bore 166 which extends upwardly into a larger cylindrical bore 168 forming a shoulder 170 at the junction of those bores. The larger bore 168 has a circumferential groove 171 which receives and holds a snap ring 173.

Coupling assembly 22 includes a bearing assembly 176 which is held within the larger bore 168 between the shoulder 170 and the snap ring 173. The bearing assembly 176 comprises a lower ball bearing 178 and upper ball bearing 180 which are spaced apart by spacer sleeve 183 which engages to inner races of the bearings 178 and 180 so that bearing 178 abuts shoulder 170 and bearing 180 abuts snap ring 173.

Assembly 22 also includes a link rod 186 which engages the cable 133 with the eccentric weight 26. The link 186 has a lower cylindrical section 188 which extends upwardly into an integral enlarged cylindrical midsection 191, with a shoulder 193 formed at the junction of link sections 186 and 191. Midsection 191 extends upwardly into an integral threaded screw 194 with a shoulder 195 formed at the junction of screw 194 and midsection 191.

Lower link section 188 has an open ended square bore 196 at its lower end. The cable 133 has a rectangular drive key 197 secured to the upper end of the cable as by brazing. The drive key 197 extends into the conforming square bore 196 and is snugly secured therein as by an adhesive so as to drivingly engage the lower link section 188 and the link 186.

The lower shoulder 193 of link 186 is supported by the upper end of bearing 180 so that downward motion of rod 186 is resisted by virtue of resistance against bearing assembly 176 by shoulder 170 of sleeve 160. A plastic cover sleeve 200 extends around part of sheath 131 and exposed section 164 of sleeve 160.

The upper end of the sheath 131 can be secured within the bore 166 of the sleeve 160 as by an adhesive so that the upper end of the sheath 131 engages the lower end of lower rod section 188.

The eccentric weight 26 comprises a larger semicylindrical portion 203 which is integral with a smaller semicylindrical portion 205. The link screw 194 extends into a threaded bore 206 of eccentric member 26 so that the flat bottom 207 of the eccentric member can be screwed flush against the upper shoulder 195 of rod midsection 191.

The eccentric weight 26 is sealed within the cavity 144 by a circular cover plate 208, which can be made of metal, to prevent exposure of the hand to rotation of the eccentric 26. Plate 208 is received in a circular groove 209 at the open end of the cavity 144, as by an adhesive.

The head housing 142 has exterior threads 212 around the mouth of the cavity 144. A detachable applicator cover 214 comprises a plastic cap 216 and a foam rubber massage pad 217 defining an applicator surface secured to the exterior side of the cap as by an adhesive. The pad 217 is shown as having a flat exterior surface, but it can have a concave, convex or other shaped surfaces as well. The cap 216 has an annular extension 218 with interior threads 220 which mesh with the threads 212 of the housing to secure the cover 214 to the housing.

Figure 7:
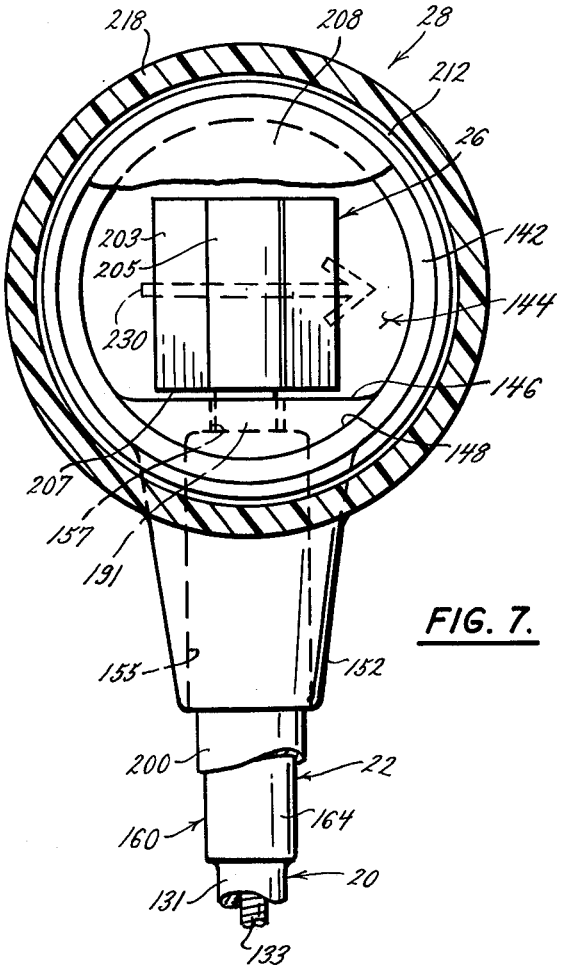
FIG. 7 is a section taken on the line 7—7 of FIG. 6 showing the applicator head, with the cover plate for the head cavity being shown partly broken.
Figure 8:
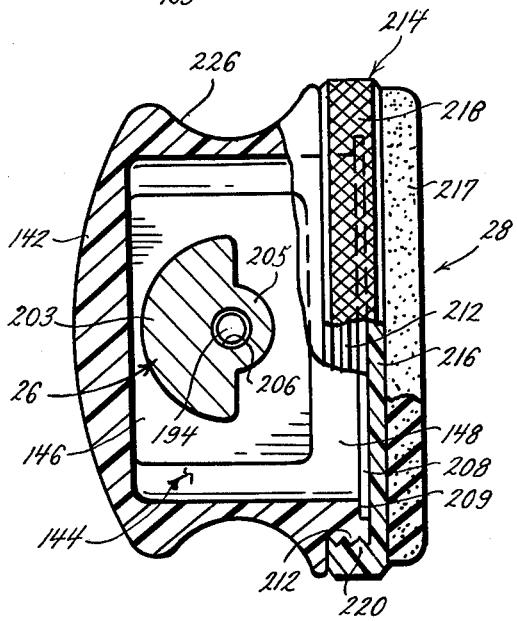
FIG. 8 is a section of the applicator head taken on the line 8—8 of FIG. 6, showing in broken lines part of the top of the head housing and head cover, and also showing in broken lines part of the top of the exterior threads of the head.
Figure 9:
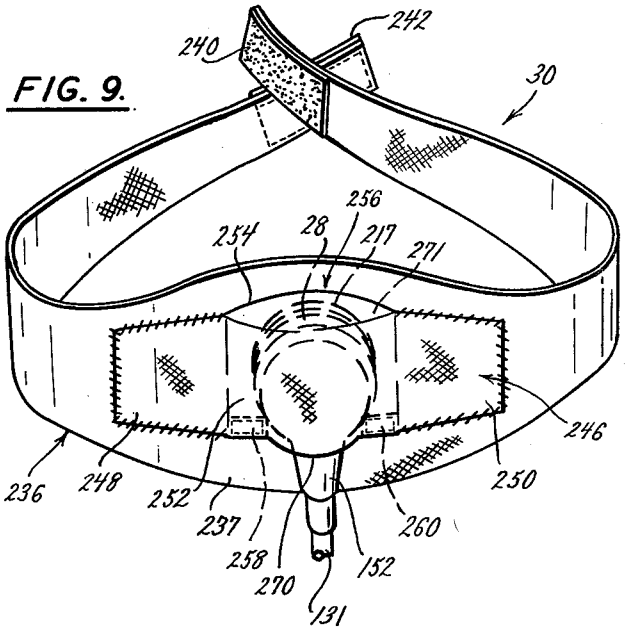
FIG. 9 is a perspective view of an applicator belt showing the applicator head supported within a pocket in the belt.

To allow ease in gripping the head 28, the housing 142 has an annular groove 226 extending around the middle portion of the housing down to the handle 152 as seen in FIGS. 6 and 8. An arrow 230, which can be made of plastic, is inlaid in a conforming recession on the back side of the housing 142 and held therein as by an adhesive.

The belt 30 (FIG. 9) allows the head 28 to be secured so that the application pad 217 can be positioned without holding the head 28 in the hand. The belt 30 comprises a larger strap 236, which can be of cloth, having fastener portions which can be synthetic fiber pads which adhere to each other when pressed together, such as Velcro brand strips 240 and 242 secured to the interior side of one strap end and the exterior side of the other strap end so that the ends can be secured together to hold the belt around the torso. Another type fastening arrangement, such as snaps, can also be used.

The strap 236 has an enlarged midsection 237. A support sheet 246, which can be of cloth, has side flaps 248 and 250 which are secured as by stitching to the rear side of midsection 237, so that a middle flap 252 is formed therebetween having a top edge 254 free from midsection 237 forming an upper opening 256 between midsection 237 and support sheet 246. On either side of the lower part of support sheet 246 and midsection 237 are pairs of Velcro latch strips 258 and 260, each pair having one strip secured as by stitching to the interior of middle flap 252, and another strip attached by stitching to the back side of midsection 237, so that the pairs can interlock with each other, and thereby latch the lower sides of sheet 246 to midsection 237. When the two pairs of Velcro latch strips 258 and 260 are fastened, a lower opening 270 is formed between them and between the back of midsection 237 and support sheet 246 so that a support pocket 271 is formed. Lower opening 270 is adapted to receive the head handle 152 but does not allow passage of the larger housing 142 of the head 28.

Figure 10:
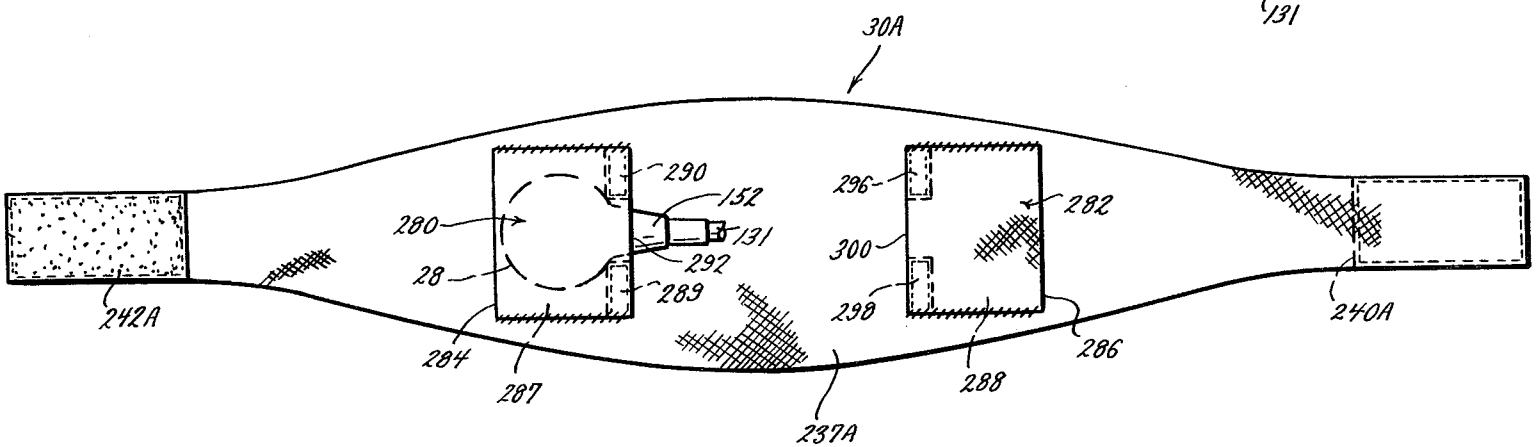
FIG. 10 is a back view of a modified applicator belt having two support pockets with the applicator head shown inserted within one of the pockets.

Another belt arrangement can also be used, so that the head 28 can be held in different positions, such as belt 30A shown in FIG. 10. Belt 30A likewise has Velcro fastener strips 240A and 242A at its ends to permit it to be secured about the patient's torso. In this case the support sheets are attached in a vertical direction across the midsection 237A. The support sheets 280 and 282 have their upper and lower ends, and their exterior edges 284 and 286 respectively stitched to midsection 237A, so that pockets 287 and 288 are formed between the midsection 237A and sheets 280 and 282 respectively. Velcro latch pairs 289 and 290, similar to latches 258 and 260, are provided on the interior edge at the top and bottom of sheet 280 and midsection 237A so that they latch the interior sides of sheet 280 to midsection 237A leaving an opening 292 between sheet 280 and midsection 237A. Sheet 280 is large enough to allow the head 28 to be inserted into pocket 287 so that the Velcro latches 289 and 290 can be secured to hold the head and allow handle 152 to extend through opening 292.

Support sheet 282 likewise has similar Velcro latch pairs 296 and 298 so that the interior edge of the support strap 282 can be secured to the back of midsection 237A forming an opening 300 therebetween. The head 28 can be inserted within pocket 288 and the latches 296 and 298 fastened around the handle 152 to hold the head in place.

It is understood that the belt support sheets can be attached at different positions on the belt to provide for a variety of holding positions for the head.

Figure 11:
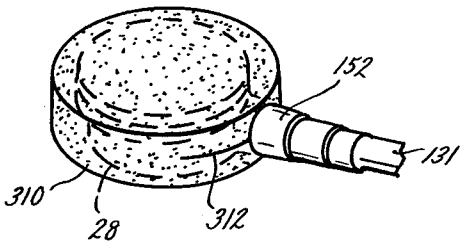
FIG. 11 is a perspective view of a cushioned sleeve as used in accordance with this invention with the applicator head being shown within.

Referring to FIG. 11 there is shown a cushioned pad 310 for use as part of the massage apparatus of this invention. The pad 310 is made of a resilient material and such as foam rubber and has an internal cavity to receive the head 28. A slit 312 is provided at the side, or peripheral edge, of the pad 310 to allow insertion of the head into the cavity.

The resilient pad 310 may be of a variety of sizes and shapes. For example, it may be shaped generally the same as the head 28 and only slightly larger as shown in FIG. 11 for purposes primarily to minimize the transmission of vibration to the patient's or therapist's hand. It would also act to some extent to buffer the impact of the directional stroking on the patient's body. Larger resilient pads of the type 310 could also be used primarily to buffer the effect of the directional stroking on the patient and to spread the directional stroking forces over a larger area of the body.

The resilient pad 310 can also be used with either of the belts 30 and 30A with the head 28 inserted within the resilient pad 310, and the pad in turn inserted into the pocket of the belt for self administration of the device.

OPERATION

The vibrator unit 10 can be operated solely by the individual patient. By gripping the applicator head with one hand with the thumb and ends of the fingers engaging the groove 226 and the palm adjacent the back side of the head, the operator can place the head 28 so that the pad 217 is flat against the chest, or other portions of the body with the arrow 230 pointed in the direction of desired mobilization or movement. With the switch 75 placed in the "on" position, rotation of shaft 81 is transferred through the coupling 104 through key 135 to cable 133 so that the cable 133 is rotated within sheath 131. The rotation of the cable 133 is transferred through key 197 to link 186 and the weighted eccentric 26 by virtue of link screw 194. The eccentric threads 206 and link screw threads 194 should have a direction that will resist the unscrewing of the eccentric 26 during rotation. The eccentric 26 rotates smoothly and evenly in cavity 144 without wobbling by virtue of the multiple point guidance of bearing assembly 176. The sides of the eccentric portions 205 and 206 do not contact the head during rotation so that a floating rotational effect is provided.

During the rotation of the eccentric 26 the bearing assembly 176 is maintained in position by virtue of its engagement against shoulder 170 and snap ring 173. Downward movement of link 186 is resisted by engagement of link shoulder 193 against upper bearing 180, while downward movement of the eccentric 26 is resisted by engagement of the eccentric bottom 207 against link upper shoulder 195. Upward movement of the eccentric 26 and link 186 is resisted by engagement of the eccentric with link screw 194 and the engagement of the link to the cable 133 through key 197.

The axial rotation of the weighted eccentric within cavity 144 is transferred by its engagement with the head 28 to the pad 217 producing in the pad or applicator surface a generally circular movement of the surface about the rotational axis of the eccentric while the surface maintains generally the same directional orientation. This imparts to that portion of the individual to which the applicator surface is applied an angular force produced by both perpendicular and parallel components relative to that portion of the individual. This directional stroking is not painful nor uncomfortable, yet the strength of the impulse is sufficient, in the case of bronchial treatment, to both loosen and mobilize bronchial secretions of the lungs in the direction of the arrow 230. The speed switch 77 can be operated to rotate the eccentric 26 at one of the two selectable speeds so that the speed of the eccentric in the high speed position causes a greater loosening and mobilization of the bronchial secretions than is caused when the switch is in the slower speed position. It is to be understood that a variable-speed motor and a variable-speed switch may also be employed.

The applicator pad 217 can also be used to improve blood circulation in body parts such as the legs. In this case the pad is placed along the legs at a location where improved circulation is desired and the directional arrow is placed pointing to the direction in which blood flow is desired. When the weighted eccentric 26 rotates, directional force is imparted through the pad to the blood vessel so that the blood is forced in the preselected direction through the blood vessel. Thus the applicator pad can be so placed to propel blood from the legs towards the heart or towards another body area.

In use to relax muscles, the applicator pad 217 can be placed against a body part so that the vibrating effect of the pad can reach a selected muscle such as the muscles in the thigh of the leg. The eccentric rotation of the weight imparts a percussive and directional force to the muscle cells. The percussive force helps to loosen waste products from the muscle tissue and the directional stroking mobilizes these waste products out of the muscle so that they can be discarded by the body.

If it is desired to remove the cap 214 and replace it with a similar cap having a different pad, the cap 214 can be simply unscrewed, preferably after the switch 75 is placed in the "off" position, and a different cap can be threaded onto the housing 142. During this interchange of caps the hands of the operator are protected from inadvertent engagement with the eccentric weight 26 by the sealed cover plate 208.

In positioning the head 28 against the body of the patient the head can be turned to the appropriate position without torsional resistance of the sheath 131 because the interior portion 122 of swivel sleeve 120 freely rotates within bore 101 of fixed sleeve 96 so that any turning of the sheath 131 likewise turns the swivel 120.

The head 28 can be used with the belt 30 to massage otherwise inaccessible parts of the body without the assistance of an attendant. This is accomplished by pulling the Velco latch strip pairs 258 and 260 apart to open the bottom portion of the middle flap 252 to allow passage of the head housing 142 through that opening so that the housing can be inserted between the midsection 237 and the middle flap 252. The pad 217 is pressed against the back side of midsection 237, with the top edge 254 of the middle flap extending above the head. The Velcro latch pairs can then be brought together to latch the lower sides of middle flap 252 to midsection 237 so that the handle 152 of the head extends through the opening 270 formed between the two latches and the head is supported in the pocket 271. The belt 30 can then be extended such as around the torso so that the head pad 217 is placed in a proper position such as against the back for bronchial treatment. The fasteners 240 and 242 of the belt can then be secured to hold the belt in position about the torso of the patient. The patient can then turn the motor on so that the vibration of the head can loosen and mobilize bronchial secretions. The patient can also adjust the speed of operation by using switch 277 without removing the belt.

The upper edge of the mid flap 252 can be modified to extend upwardly a greater distance and be sewn to the midsection 237 to prevent movement of the head 28 upwardly out of the pocket 271.

If desired the Velcro latches 258 and 260 can be eliminated, and the lowerside portions of the middle flap 252 can be sewn to the midsection 237 leaving the opening 270 to receive the handle 152 so that the sewn lower edges of the side of middle flap form the pocket 271 to support the head. When this alternative arrangement is used the head is inserted by disengaging the swivel sleeve 120 from fixed sleeve 96 by removal of set screw 128 from groove 124 and pulling the swivel sleeve section 122 out of bore 101 and simultaneously pulling key 135 out of coupling bore 116. After the disengagement, the swivel sleeve 120 can be inserted in the upper opening 256 between the middle flap and midsection and inserted through the lower opening 270 so that the head can be inserted bottom end first into the pocket 271 with the handle 152 extending through the lower opening 270 between the sewn sides of the lower mid flap 252. The coupling assembly 16 can then be reengaged. The detachable nature of the coupling assembly 16 thus allows the head to be inserted when the Velcro lower latches are not used and the lower sides of the middle flap are permanently stitched.

With belt 30A (FIG. 10) the head 28 can be inserted within either of the sheet pockets 287 or 288 by unfastening the Velcro latch pairs for either of the pockets and inserting the head 28 therein so that the pad 217 is supported against the back of section 237A. The Velcro latches can then be secured to hold the head securely in place. The belt 30A can then be wrapped around the torso and secured in place by end fasteners 240A and 242A. After the belt is secured the applicator head and pad can be placed in position and operated as heretofore described.

In all cases of the use of the belts 30 and 30A the pockets are tight enough and the Velcro latches have sufficient strength to maintain proper engagement and alignment of the head 28 during vibration so that the head does not jerk out of place. It should also be noted that the generally flat disc shape of the head and the attachment of the flexible drive cable at the periphery of the head makes it practical for use with the belts and allows the patient to lie on the applicator head with minimal discomfort.

The head 28 can be used with cushioned pad 310 to minimize the transmission of vibration to the patient's or therapist's hand and/or to minimize the percussive directional stroking forces applied to the patient's body. Both the head and cushioned pad can also be used with the belts heretofore described with the head within the cushioned pad and the pad in turn held against the patient's body by use of the belt.

The present unit allows the patient to self-administer the applicator at otherwise inaccessible locations on his body with complete safety in his home or at places other than a medical center or hospital. The patient can carry the motor and its housing by the handle 71 to a different location. In transportation, the swivel sleeve 120 can be disengaged from the fixed sleeve 96 as previously described so that the unit can be transported or stored compactly in two pieces.

It is to be understood that the foregoing description and the accompanying drawings have been given by way of illustration and example. It is also to be understood that changes in form of the elements, rearrangement of parts, and substitution of equivalent elements, which will be obvious to those skilled in the art, are contemplated as within the scope of the present invention which is limited only by the claims which follow.

What is claimed is:

1. A massage apparatus for therapeutic use by an individual comprising an applicator head shaped as a generally flat disc and having an applicator surface formed as one side of the disc for application to a portion of the body of the individual, and drive means producing a generally circular movement of the applicator surface about an axis generally parallel to said surface while said surface maintains generally the same directional orientation, thereby imparting to that portion of the individual to which said applicator surface is applied an angular force produced by both perpendicular and parallel components with respect to said portion of the individual, said drive means including a drive member secured to the periphery of said disc, and comprising a resilient pad, means associated with said pad providing insertion of said applicator head therein for encasing the head in the pad, whereby said pad minimizes the transmission of vibration to the user's hand, or minimizes the impact of the massaging action transmitted to the patient's body.

2. The massage apparatus of claim 1 further comprising a belt, means associated with said belt supporting said applicator head and resilient pad, and means for securing said belt to a selected portion of the body of said individual to hold the resilient pad with the applicator head encased therein in a selected position firmly against the body.

3. A massage apparatus for therapeutic use by an individual comprising an applicator head shaped as a generally flat disc and having an applicator surface formed as one side of the disc for application to the body of the individual, said applicator head being sized to be grasped with one hand with the thumb and at least some of the fingers engaging the periphery of the disc shaped head and with the palm of the hand adjacent the side of the applicator head opposite the applicator surface, and drive means producing a mechanical vibration of the applicator surface, said drive means including a motor external of said applicator head, a rotatably driven member within said aplicator head, and a flexible drive cable, means connecting one end of the flexible drive cable to the motor for rotation in response to operation of said motor, and means at the periphery of said applicator head for connecting the other end of said cable to said rotatably driven member within said applicator head, and comprising a resilient pad, means associated with said pad providing insertion of said applicator head therein for encasing the head in the pad, whereby said pad minimizes the transmission of vibration to the user's hand, or minimizes the impact of the massaging action transmitted to the patient's body.

4. The massage apparatus of claim 3 further comprising a belt, means associated with said belt supporting said applicator head and resilient pad, and means for securing said belt to a selected portion of the body of said individual to hold the resilient pad with the applicator head encased therein in a selected position firmly against the body.

5. A massage apparatus for therapeutic use by an individual comprising:

(a) an applicator head comprising a housing having a portion of a generally cylindrical shape, the housing having an exterior peripheral gripping groove located about the approximate middle of the housing, said housing having a cavity and an opening for the cavity;

(b) said head further comprising a detachable disc secured to the housing to cover the cavity opening, said disc having a generally flat applicator surface with a resilient portion formed at one side of the disc for application to the body;

(c) a weighted member eccentrically mounted within said cavity, said weighted member being sized to pass through the housing cavity opening;

(d) a shaft mounted within the housing for rotational movement, the shaft being engaged to the weight member to rotate the weight member;

(e) means to power rotation of said shaft located outside the housing.

6. The structure of claim 5 wherein the power means comprises a motor, and further comprising a flexible cable connected at one end to said shaft, a housing surrounding said motor, and means coupling the other end of said cable into driving engagement with the motor and for swivel movement of the other end of the cable relative to said motor housing generally about the rotational axis of said cable at the location of said swivel coupling.

7. The structure of claim 6 wherein the flexible cable has a sheath, and wherein the swivel means further comprises a sleeve secured to the sheath and rotatably engaged to the motor housing.

8. The structure of claim 5 wherein said peripheral groove is of a curved cross section.

9. The structure of claim 5 further comprising a plate mounted between the detachable disc and the housing, the plate being sized to cover the cavity opening of the housing.

10. The structure of claim 5 further comprising an indicator on the applicator head to indicate the direction of rotary movement of the weight member.

11. The structure of claim 5 further comprising a belt having a pocket for receiving and covering part of said head and means for securing the belt to a selected portion of the body of the individual to hold the applicator surface in the selected position firmly against the body.

12. The structure of claim 5 further comprising a resilient pad, means associated with the pad providing insertion of said applicator head therein for encasing the head in the pad, whereby the pad minimizes the transmission of vibration of the user's hand, or minimizes the impact of a massaging action transmitted to the body.

13. A massage apparatus for therapeutic use by an individual comprising:

(a) an applicator head comprising a housing having a peripheral gripping groove of curved cross section extending about its exterior in approximately the middle portion of the housing, said housing having a cavity and an opening for the cavity;

(b) the head further comprising a generally flat disc detachably secured to an end of the housing to cover said cavity opening, said disc having a resilient applicator surface formed as one side of the disc for application to a portion of the body of the individual;

(c) an eccentrically mounted weight member within said housing cavity for rotary movement therein, the weight member sized to pass through the cavity opening;

(d) a rigid shaft secured to the weight member to rotate it;

(e) bearing means within said housing for guiding the rotation of the shaft; and (f) means to rotate said eccentric member within the housing comprising a flexible drive cable connected at one end to said applicator head, a motor, a housing surrounding the motor, and means coupling the other end of the cable in driving engagement with the motor and for swivel movement of said other end of the cable relative to the motor housing generally about the rotational axis of the cable at the location of the swivel coupling.

14. The structure of claim 13 further comprising a belt having a pocket for receiving and covering part of the applicator head, and means for securing the belt to a selected portion of the body of the individual to hold the applicator surface in a selected position firmly against the body.

15. The structure of claim 13 further comprising a resilient pad, means associated with the pad providing insertion of the applicator head therein for encasing the head in the pad, to minimize the transmission of vibration to the user's hand, or minimize the impact of the massaging action transmitted to the body.

16. The structure of claim 13 further comprising an indicator on the applicator head to indicate the direction of rotary movement of the weight member.

17. The structure of claim 16 wherein the flexible cable has a sheath, and wherein the swivel means further comprises a sleeve secured to the sheath and rotatably engaged to the motor housing.

18. The structure of claim 13 further comprising a plate mounted between the detachable disc and the housing, the plate being sized to cover the cavity opening of the housing but being of smaller diameter than the disc.

19. The structure of claim 13 wherein the groove cross section is symmetrical and extends to a depth into the housing of no greater than one inch.

20. A massage apparatus for therapeutic use by an individual comprising:

(a) an applicator head comprising a housing having a portion of generally cylindrical shape, said cylindrically shaped portion having an exterior symmetrical peripheral gripping groove of a depth no greater than one inch located about the approximate middle of the housing, said housing having a cavity with an opening for the cavity;

(b) said head further comprising a detachable disc secured to the housing to cover the cavity opening, said disc having a generally flat applicator surface with a resilient portion formed as one side of the disc for application to the body, a plate mounted between the detachable disc and the housing, the plate being sized to cover the cavity opening of the housing but being of smaller diameter than the disc;

(c) a weighted member eccentrically mounted within the cavity, the weighted member being sized to pass through the housing cavity opening;

(d) a rigid shaft secured to the weight member to rotate it within the cavity;

(e) means to rotate the eccentric member within the housing comprising a flexible drive cable drivingly coupled at one end to said shaft, a motor, a housing surrounding the motor, a sheath for the cable, and a sleeve secured to the sheath and rotatably engaged to the motor housing; and (f) an indicator on the applicator head to indicate the direction of rotary movement of the weight member.

* * * * *